US005426495A

United States Patent [19]

Sawamura et al.

[11] Patent Number: 5,426,495

[45] Date of Patent: Jun. 20, 1995

[54] IMAGE FIXING DEVICE HAVING HEATING PORTION AT ONE END THEREOF

[75] Inventors: Eiji Sawamura, Yokohama; Toshiaki Higaya, Kawasaki, both of Japan

[73] Assignee: Ricoh Company, Ltd., Tokyo, Japan

[21] Appl. No.: 187,496

[22] Filed: Jan. 28, 1994

[30] Foreign Application Priority Data

| | | | |
|---|---|---|---|
| Feb. 4, 1993 | [JP] | Japan | 5-017502 |
| Mar. 11, 1993 | [JP] | Japan | 5-050800 |
| Mar. 26, 1993 | [JP] | Japan | 5-068329 |
| Apr. 15, 1993 | [JP] | Japan | 5-088795 |
| May 14, 1993 | [JP] | Japan | 5-030603 |
| Sep. 6, 1993 | [JP] | Japan | 5-221229 |

[51] Int. Cl.[6] ..... G03G 15/20

[52] U.S. Cl. ..... 355/285; 165/89; 219/216; 219/469; 432/60

[58] Field of Search ..... 355/282, 285, 290, 292; 219/216, 469–471; 432/60, 228; 165/89, 104.19, 104.21, 104.23, 104.24

[56] References Cited

U.S. PATENT DOCUMENTS

| | | | |
|---|---|---|---|
| 3,952,798 | 4/1976 | Jacobson et al. | 165/89 X |
| 4,091,264 | 5/1978 | Sarcia | 219/469 |
| 4,105,896 | 8/1978 | Schuster | 219/470 |
| 4,172,976 | 10/1979 | Namiki et al. | 219/469 |
| 4,229,644 | 10/1980 | Namiki et al. | 219/469 |
| 4,284,875 | 8/1981 | Namiki et al. | 219/216 |

*Primary Examiner*—William J. Royer

*Attorney, Agent, or Firm*—Oblon, Spivak, McClelland, Maier & Neustadt

[57] ABSTRACT

In an image forming apparatus, an image fixing device has a hollow cylindrical fixing roller implemented as a heat pipe, and a pressing roller held in pressing contact with the fixing roller. The fixing roller is made up of a fixing portion, and a paper nipping portion against which the pressing roller is constantly urged. The paper nipping portion has a greater wall thickness than the heating section. This kind of configuration promotes rapid heat conduction from a halogen heater to a working fluid filled in the heat pipe, while preventing the paper nipping portion of the fixing roller from being deformed by the pressing roller.

26 Claims, 11 Drawing Sheets

IMAGE FIXING DEVICE HAVING HEATING PORTION AT ONE END THEREOF

BACKGROUND OF THE INVENTION

The present invention relates to a copier or similar image forming apparatus and, more particularly, to an image fixing device having a fixing roller implemented as a heat pipe and a pressing roller held in pressing contact with the fixing roller.

It is a common practice with a copier or similar electrophotographic image forming apparatus to electrostatically transfer a toner from a photoconductive element to a paper, fix the toner image on the paper by an image fixing unit, and then discharge the paper, or copy, to the outside of the copier. In the image fixing device, a fixing roller is heated while a pressing roller is held in pressing contact with the fixing roller. The two rollers fix the toner image on the paper by heat and pressure while conveying the paper in cooperation. It has been customary to heat the fixing roller by a heater accommodated in the fixing roller and extending in the axial direction of the roller. In this type of fixing device, since the fixing roller is subjected to heat and pressure, the fixing ability thereof is sequentially lowered due to, for example, contamination by the toner. Moreover, the heater disposed in the fixing roller is apt to snap. In the event of such an occurrence, the fixing roller is replaced with a new fixing roller. However, the problem is that the replacement of the fixing roller is time- and labor-consuming due to conducting means arranged to feed power to the heater.

In the light of the above, Japanese Patent Laid-Open Publication No. 4-32885 teaches an image fixing device having a fixing roller constituted by a heat pipe which is open at one end thereof. A conical heat receiving tube is formed with a number of projections and recesses on the inner periphery thereof. The heat receiving tube is inserted in the open end of the heat pipe with the apex thereof facing the inside of the heat pipe. A heater unit is accommodated in the heat receiving unit while the heat pipe is filled with a working fluid. In this configuration, heat generated by the heater unit is transferred to the working fluid efficiently via the heat receiving tube, thereby heating the heat pipe or fixing roller. With this conventional device, it is possible to promote efficient heat transfer and efficient replacement, reduce a preheating time, and set up a uniform temperature distribution over the entire fixing roller.

However, the conventional fixing device described above as some problems left unsolved, as follows. To begin with, the fixing roller implemented by a heat pipe needs a heating portion having a substantial length. In addition, the heater unit uses a halogen heater as a heat source and, therefore, increases the diameter of the fixing roller. As a result, the fixing device and an image forming apparatus using it are bulky. Assume that the heating portion of the fixing roller has the length thereof reduced in order to miniaturize the overall image forming apparatus. Then, since a great amount of heat is locally conducted to the heating portion within a predetermined period of time, the heating portion is subjected to a temperature higher than 200° C. In this condition, it is likely that the heating portion is heated to above the breakdown limit thereof and bursts.

It is a common practice to coat the outer periphery of a paper nipping portion, which forms part of the fixing roller, with a PFM or similar fluoric resin so as to promote easy parting. Usually, a fluoric resin layer is formed by applying a fluoric resin solution to the outer periphery of the paper nipping portion and then baking it at 350° C. to 400° C. for 20 minutes to 40 minutes. However, when the fixing roller filled with a working fluid, as stated above, is baked under such conditions, the pressure inside the cavity of the roller is apt to rise to a pressure high enough to cause the roller to burst.

Further, while the heat pipe is usually made of copper and provided with a wall thickness of 1.0 mm to 1.5 mm, it is apt to deform due to high temperature (150° C. to 200° C.) and pressure attributable to the pressing roller. As a result, the fixing ability available with the device is lowered at the center of the paper nipping portion of the fixing roller.

Moreover, heat has to be transferred from the heating portion to the paper nipping portion of the fixing roller within the cavity of the roller. To effect such heat conduction, the cavity of the roller, which is filled with the working fluid, is required to have a volume great enough for the fluid to evaporate and then condense. Hence, when heat generated by the heater unit is transferred to the fluid via the conical heat receiving tube inserted in the heat pipe, as stated earlier, the heating efficiency is low.

SUMMARY OF THE INVENTION

It is, therefore, an object of the present invention to provide an image fixing device which prevents a fixing roller from deforming due to the pressing contact of a pressing roller therewith.

It is another object of the present invention to provide an image fixing device which allows a fixing roller to reach a predetermined operating temperature rapidly, thereby enhancing the heating efficiency.

It is a further object of the present invention to provide an image fixing device operable with a relatively short heating portion, as measured in the axial direction, thereby promoting miniaturization and safety operation.

A device for fixing a toner image transferred to a paper on the paper by heat and pressure of the present invention has a fixing roller implemented by a hollow cylindrical heat pipe having opposite ends thereof closed and filled with a working fluid. The heat pipe has a heating portion at one end portion thereof which is to be heated, and a paper nipping portion to be supplied with the vapor of the working fluid vaporized by heat from the heating portion and to be heated by condensation of the vapor. A pressing roller is held in pressing contact with the paper nipping portion of the heat pipe. The toner image is fixed on the paper when the paper sheet is conveyed by the fixing roller and pressing roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
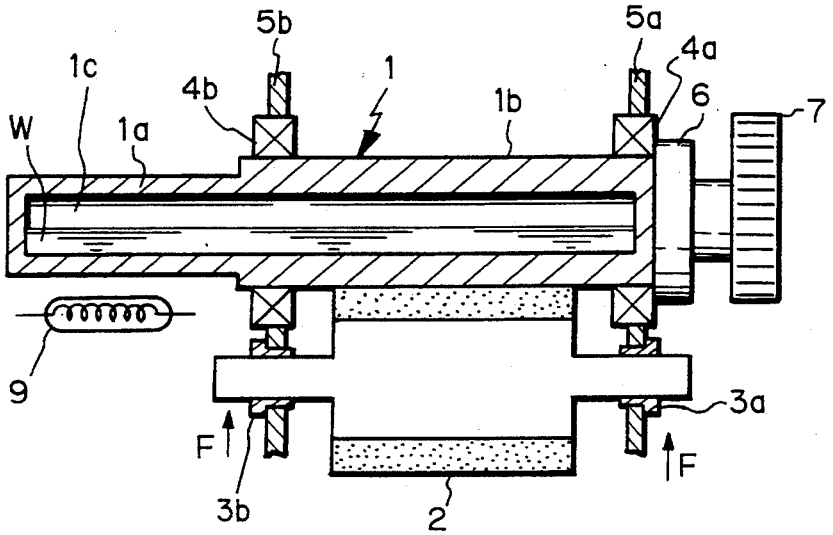
FIG. 1 is a fragmentary vertical section showing an image fixing device embodying the present invention.

Referring to FIG. 1 of the drawings, an image fixing device embodying the present invention is shown. As shown, the fixing device has a fixing roller 1 implemented as a hollow cylindrical body made of copper and closed at opposite ends thereof. The closed cavity 1c of the fixing roller 1 is depressurized and filled with a working fluid, i.e., water W. The fixing roller 1 has a heating portion 1a adjacent one end thereof and a paper nipping portion 1b adjacent the other end. The heating portion 1a has a smaller outside diameter and a thinner wall than the paper nipping portion 1b. A halogen heater 9 is disposed below the heating portion 1a in order to heat the fluid W. With this configuration, the fixing roller 1 constitutes a heat pipe. Specifically, the fluid W is heated and evaporated by the halogen heater 9 via the cylindrical wall of the heating portion 1a. The resulting vapor is scattered into the paper nipping portion 1b of the roller 1 almost at sonic speed and then condensed to heat the portion 1b. This kind of arrangement allows a heating or vaporizing portion and a heat radiating or condensing portion to be spaced apart from each other, transfers a great amount of heat while maintaining the temperature difference small, and sets up a substantially uniform temperature distribution over the entire roller 1. The roller 1 is rotatably supported by bearings 4a and 4b at opposite ends of the paper nipping portion 1b. The bearings 4a and 4b are affixed to side walls 5a and 5b, respectively.

A pressing roller 2 is pressed against the fixing roller 1 from below and rotatably supported by bearings 3a and 3b at opposite ends thereof. Biasing means, not shown, constantly urges the pressing roller 2 in a direction indicated by an arrow F in the figure. A heat insulating plate 6 is affixed to the end of the fixing roller 1 remote from the heating portion 1a. Drive means, not shown, is drivably connected to the fixing roller 1 via a drive gear 7 which is mounted on the same shaft as the heat insulating plate 6. The fixing roller 1, driven by the drive means, conveys a paper while nipping it in cooperation with the pressing roller 2, at the same speed as the paper transport speed. Specifically, a toner image is transferred to a paper at an image transfer station, not shown, included in a copier. The paper with the toner image is fed to the position where the fixing roller 1 and pressing roller 2 contact each other. As a result, the toner on the paper melts due to the pressure and heat, penetrates into the paper, and then solidifies. The paper with such a solidified or fixed image is driven out of the copier.

How to transfer heat to and vaporize the fluid W rapidly is the key to the reduction of the period of time necessary for the heating roller 1 to be heated to a predetermined temperature. In the illustrative embodiment, the halogen heater 9 heats the thinner heating portion 1a which constitutes one end portion of the heating roller 1. Hence, heat applied to the surface of the heating portion 1a is transferred to the depressurized cavity 1c rapidly, causing the fluid W to vaporize rapidly. This is successful in causing the fixing roller 1 to reach the operating temperature thereof in a short period of time. On the other hand, the paper nipping portion 1b, which has a thicker wall than the heating portion 1a, is provided with an increased bending strength against pressure forces. A temperature sensor, not shown, is located in close proximity to the heating portion 1a. In response to the output of the temperature sensor, the temperature of the heating portion 1a is so controlled as to remain in a range lower than the breakdown limit of the heating portion 1a and higher than the heat radiation temperature of the paper nipping portion 1b.

Figure 2:
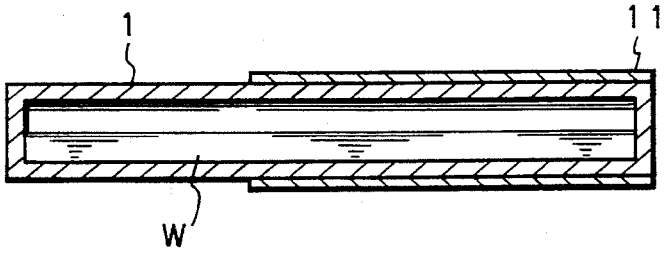
FIGS. 2–4 are fragmentary vertical sections each showing an alternative embodiment of the present invention.

FIG. 2 shows an alternative embodiment of the present invention. In the figure, the same or similar constituent parts as or to the parts of the previous embodiment are designated by the same reference numerals, and a detailed description thereof will not be made in order to avoid redundancy. The arrangement not shown in FIG. 2 may be identical to the arrangement of FIG. 1. As shown, the fixing roller 1 has the same wall thickness over the entire length thereof. A reinforcing tube 11 surrounds the paper nipping portion 1b which is to be pressed against the heat roller 2. The reinforcing tube 11 is made of stainless steel, iron or similar rigid metal whose vertical coefficient of elasticity is higher than $1.25\times104$ kgf/mm$^2$. In this configuration, the tube 11 prevents the pressure exerted by the pressing roller 2 thereon from influencing the paper nipping portion 1b of the fixing roller 1. Hence, the roller 1 is prevented from being deformed by the force of the roller 2. The tube 11 exhibits the expected reinforcing ability without obstructing the heat transfer from the paper nipping portion 1b, only if it has a wall thickness of 0.2 mm to 3.0 mm, preferably 0.2 mm to 1.5 mm.

Figure 3:
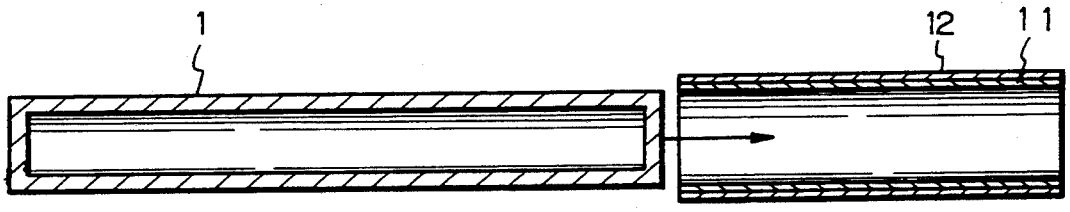

Another alternative embodiment of the present invention will be described with reference to FIG. 3. This embodiment is similar to the embodiment of FIG. 2 except for a fluoric resin layer 12 covering the reinforcing tube 11. Generally, the fixing roller 1 is covered with a PFA or similar fluoric resin layer for the purpose of enhancing the parting ability thereof. Specifically, it is a common practice to apply a fluoric resin solution to the surface of the fixing roller 1 and then bake it at a temperature as high as 350° C. to 400° C. Assume that after the reinforcing tube 11 has been mounted on the fixing roller 1 and applied with a fluoric resin solution, the roller 1 is heated at 350° C. to 400° C. in order to form the resin layer 12 on the tube 11. Then, it is likely that the depressurized cavity 1c of the fixing roller 1 is pressurized up to about 60 kgf/cm$^2$ due to the vapor pressure of the fluid or water W. This would cause the roller 1, which is designed on the assumption of an operating vapor pressure of 20 kgf/cm$^2$ to 30 kgf/cm$^2$, to burst.

In the light of the above, in the illustrative embodiment, a fluoric resin solution is applied to the outer periphery of the tube 11, which is made of copper or similar metal, and then baked by a conventional method to form the fluoric resin layer 12 on the tube 11. Subsequently, the paper nipping portion 1*b* of the fixing roller 1 is inserted into the tube 11 to complete the fixing roller 1. Although some deformation may occur when the paper nipping portion 1*b* made of copper is inserted into the tube 11, the outer periphery of the tube 11 is not deformed at all.

Figure 4:
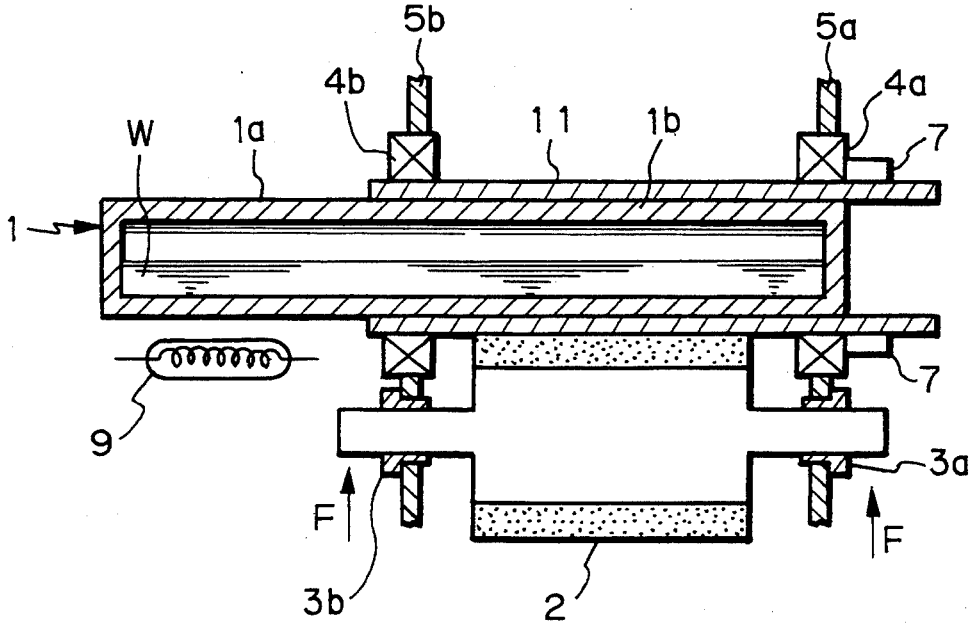
Figure 5:
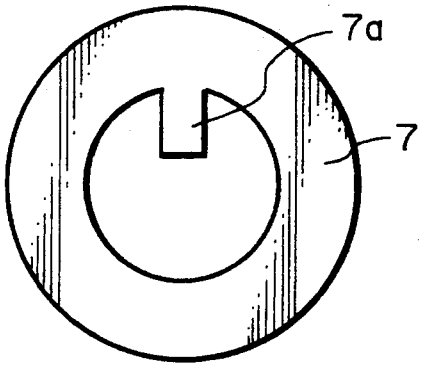
FIG. 5 is a side elevation of a reinforcing tube.

FIG. 4 shows another alternative embodiment of the present invention. As shown, the reinforcing tube 11 shown in FIG. 2 surrounds the end portion of the fixing roller 1 remote from the heating portion 1*a*, while protruding from the end portion sideways. The drive gear 7 is made of a highly heat insulating resin and affixed to the outer periphery of the protruding portion of the tube 11. The tube 11 is shown in FIG. 5 in a cross-sectional view. As shown, a lug 7*a* extends from the inner periphery of the drive gear 7 toward the axis of the gear 7, while an axial slot is formed in the protruding portion of the tube 11 for receiving the lug 7*a*. When the drive gear 7 and tube 11 are assembled with the lug 7*a* thereof received in the slot, the gear 7 is prevented from idling. As stated above, the drive gear 7 is made of a highly heat insulating resin and affixed to the outer periphery of the protruding portion of the tube 11. This reduces the number of constituent parts and promotes easy assembly.

Figure 6:
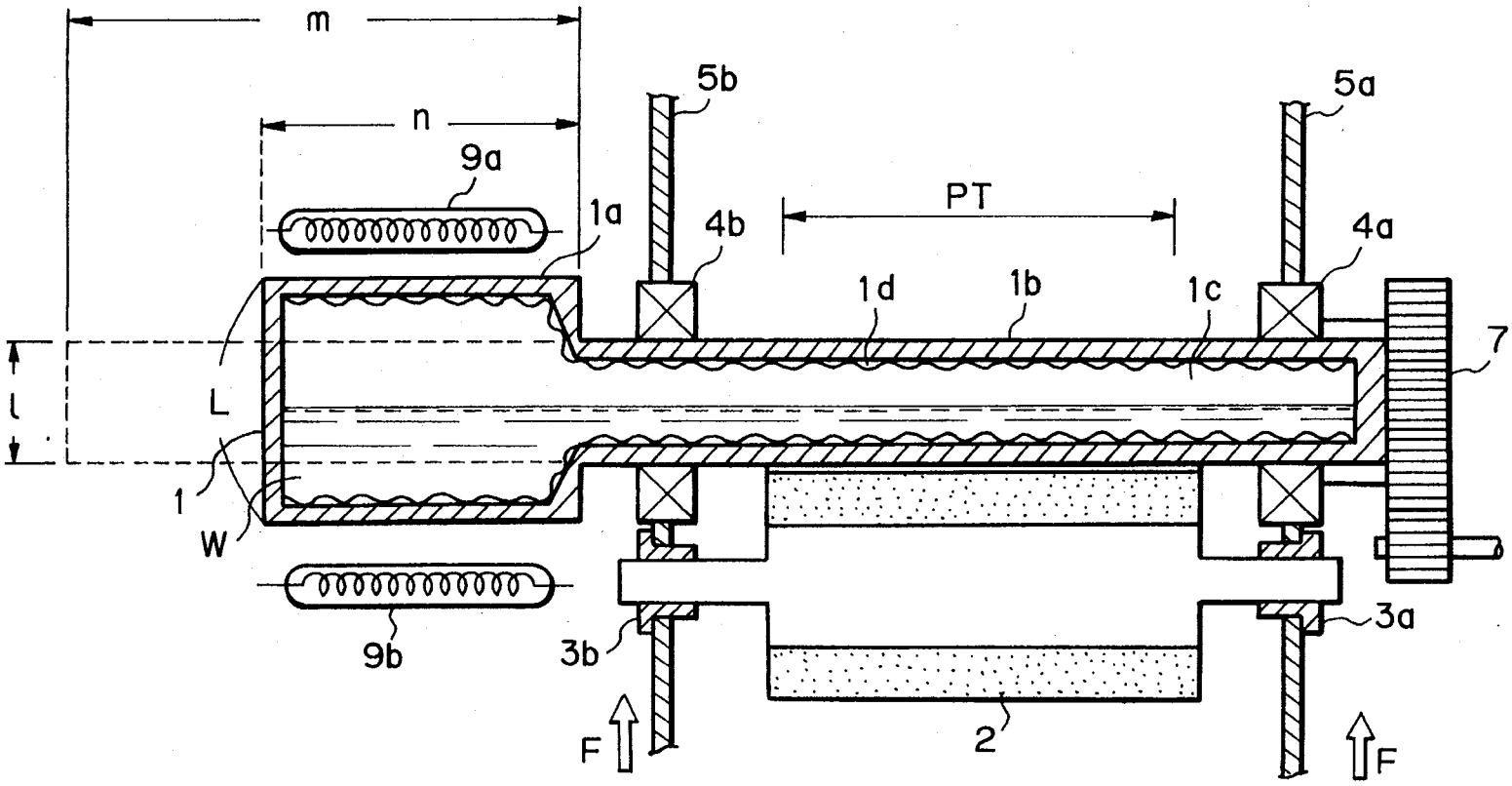
FIGS. 6–9 are fragmentary vertical sections each showing another alternative embodiment of the present invention.

Referring to FIG. 6, another alternative embodiment will be described. As shown, the heating portion 1*a* of the heating roller 1 is provided with a greater diameter than the paper nipping portion 1*b*, but the length thereof is reduced in the axial direction so as to reduce the overall size of the device. The surface of the heating portion 1*a* is colored black to absorb heat rays easily. A parting layer, not shown, is formed on the outer periphery of the paper nipping portion 1*b* over a paper transport range PT and is covered with a fluoric resin layer. The wall of the depressurized cavity 1*c* of the roller 1 is covered with a mesh portion 1*d* exhibiting a capillary action. The mesh portion 1*d* is implemented by a metal net or sintered metal or similar porous material generally referred to as a wick.

Specifically, the heating portion 1*a* of the fixing roller 1 has an outside diameter L greater than the outside diameter l and inside diameter of the paper nipping portion, or heat radiating portion, 1*b*. Therefore, the amount of heat received and the amount of fluid W accommodated available with the heating portion 1*a* per unit length in the axial direction are respectively greater than the amount of heat radiation and the amount of fluid accommodated available with the paper nipping portion 1*b*. Assume that the outside diameter L of the heating portion 1*a* is equal to the outside diameter l of the paper nipping portion 1*b*, and that the overall heat receiving area equal to one available with the heating portion 1*a* having the outside diameter L is desired. Then, it is necessary to increase the length n of the heating portion 1*a* in the axial direction to a length m. By contrast, when the heating portion 1*a* has the outside diameter L thereof increased, the length n thereof can be reduced in a corresponding amount, thereby reducing the overall size of the device. In this embodiment, the halogen heater is made up of halogen heaters 9*a* and 9*b*.

Figure 7:
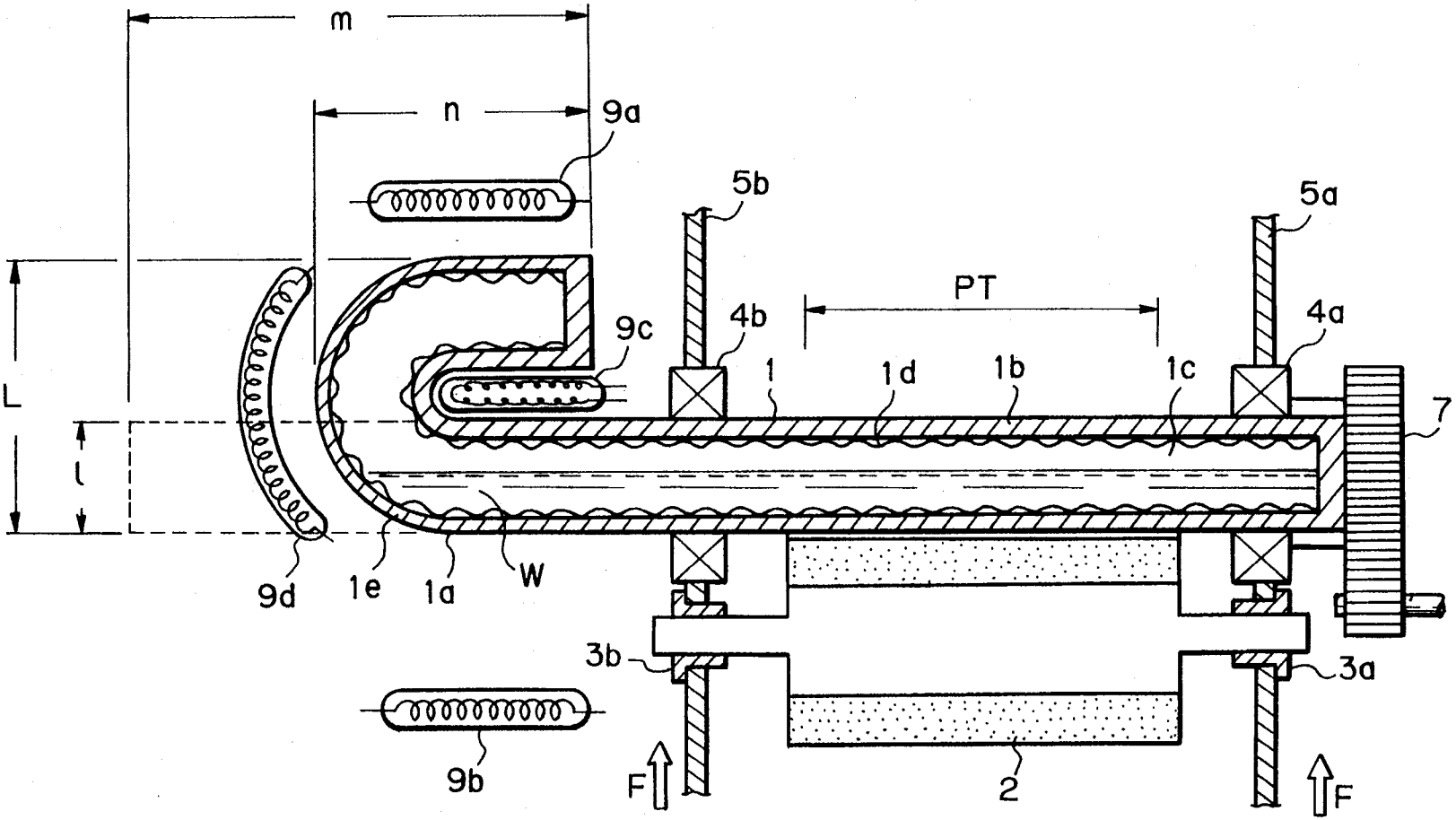

FIG. 7 shows another alternative embodiment which is similar to the embodiment of FIG. 6 except for the configuration of the heating portion 1*a*. As shown, the heating portion 1*a* is made up of a straight portion having an outside diameter equal to the outside diameter l of the paper nipping portion 1*b*, and a bent portion 1*e* formed by turning over the end of the straight portion. Specifically, this embodiment reduces the overall size of the device by bending the heating portion 1*a*, instead of increasing the diameter of the portion 1*a*. This insures the required total heat receiving area without increasing the length n of the heating portion 1*a* to m. In this embodiment, the halogen heater is made up of halogen heaters 9*a*, 9*b*, 9*c* and 9*d*. The halogen heaters 9*a*, 9*b* and 9*c* are located in close proximity to the outer periphery of the heating portion 1*a* while the halogen heater 9*c* is interposed between the walls of the bent portion 1*e*.

Figure 8:
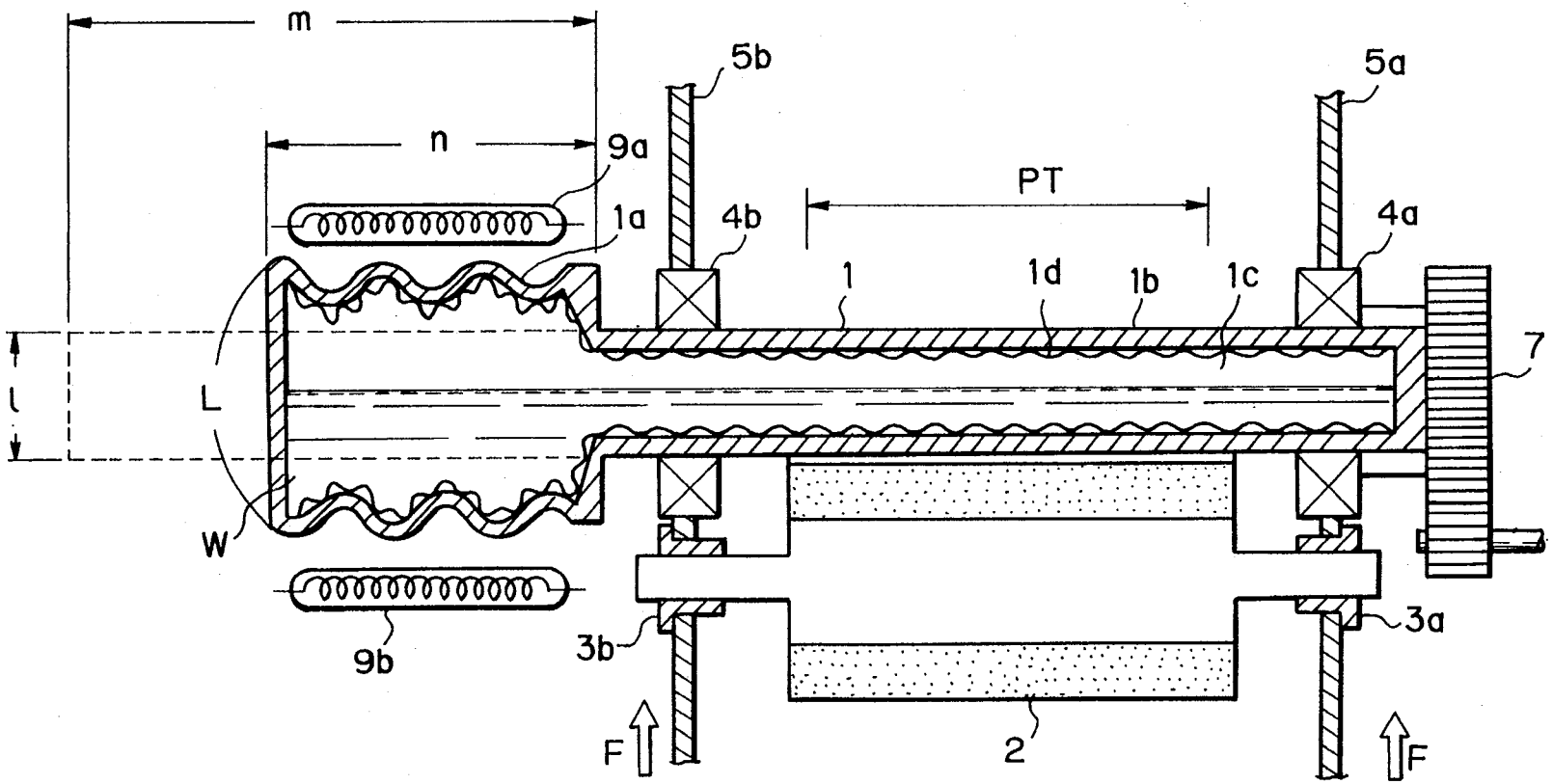

FIG. 8 shows another alternative embodiment which is also similar to the embodiment of FIG. 6 except for the configuration of the heating portion 1*a*. As shown, while the outside diameter L of the heating portion 1*a* is greater than the outside diameter l of the paper nipping portion 1*b*, the peripheral wall of the heating portion 1*a* is configured into a bellows. The bellows-like heating portion 1*a* receives a greater amount of heat per unit length in the axial direction than the heating portion 1*a* of FIG. 6. Hence, the length n of the heating portion 1 a can be further reduced. In this embodiment, the halogen heater is made up of halogen heaters 9*a* and 9*b*.

Figure 9:
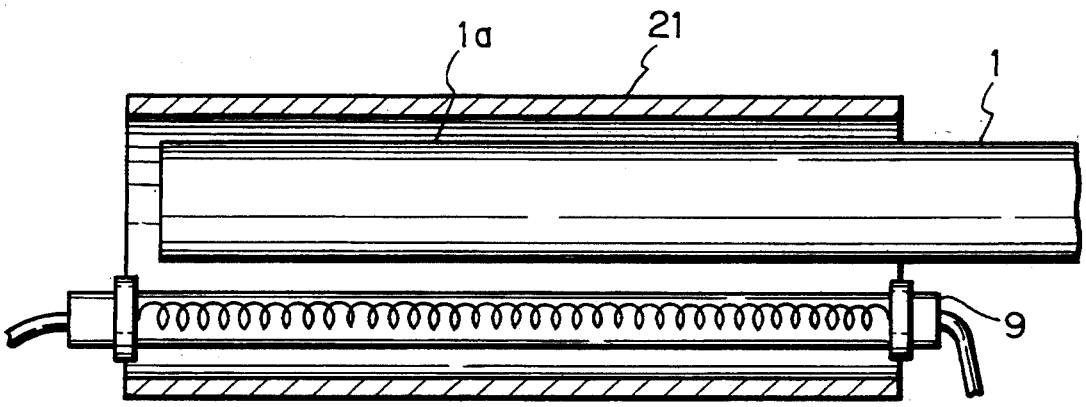
Figure 10:
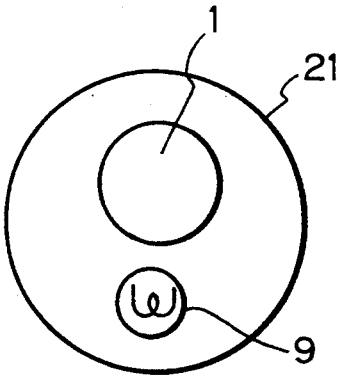
FIG. 10 shows the embodiment of FIG. 9 in a side elevation.

FIGS. 9 and 10 show still another alternative embodiment of the present invention. As shown, a tubular cover 21 made of aluminum surrounds the entire halogen heater 9 and the heating portion 1*a* of the fixing roller 1. In the embodiment, the cover 21 has the inner periphery thereof polished by electrolysis to have reflectivity as high as 80%. In this construction, although the heat rays radiated from the halogen heater 9 are scattered, the highly reflective inner periphery of the cover 21 reflects them and causes them to concentrate toward the center thereof. As a result, the heat rays heat the lower part of the heating portion 1*a* effectively, enhancing the thermal efficiency of the entire device.

Figure 11:
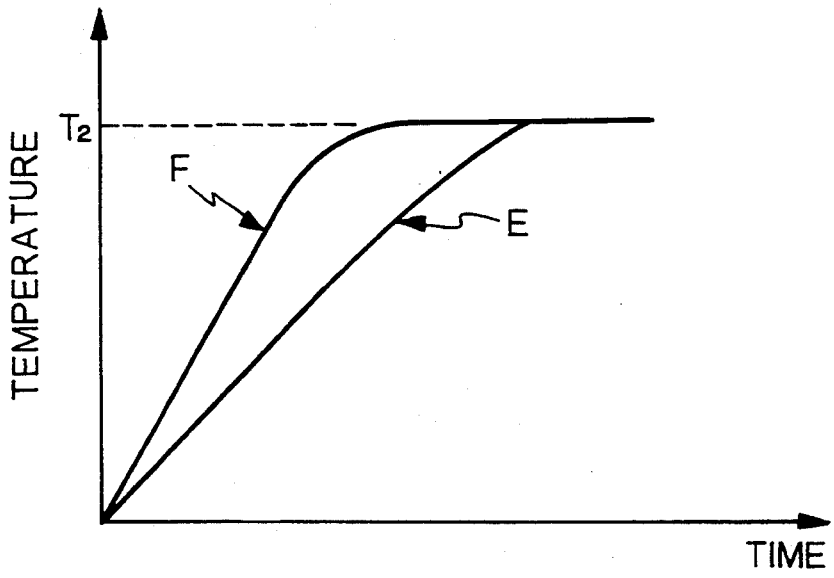
FIG. 11 is a graph representative of a temperature elevation characteristic of a paper nipping portion forming part of a fixing roller.
Figure 12:
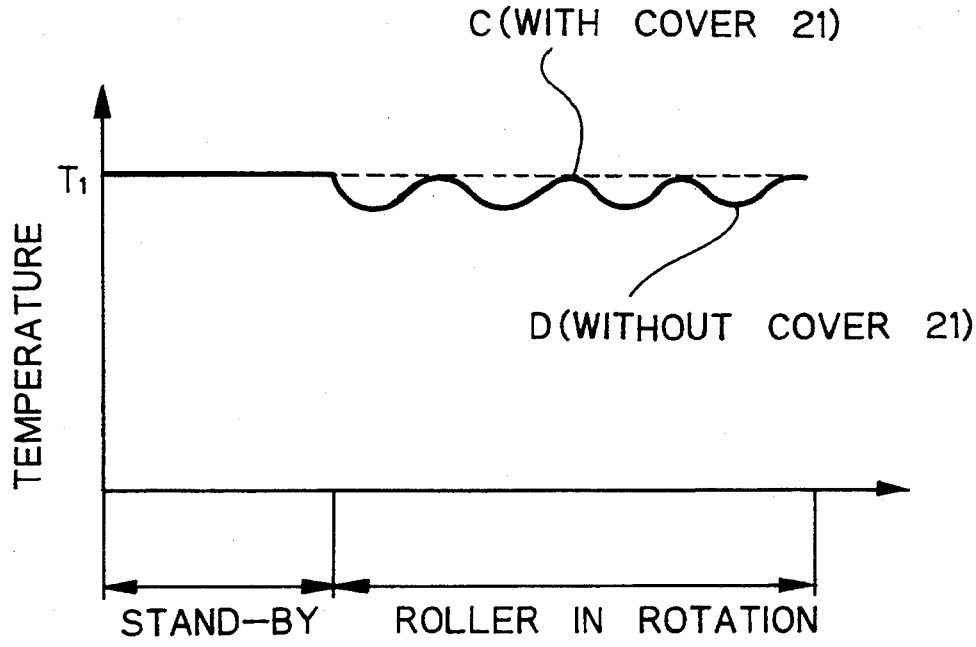
FIG. 12 is a graph representative of a temperature characteristic of a fixing roller in a stand-by condition and during operation.

FIG. 11 is a graph representative of the temperature elevation characteristic of the paper nipping portion 1*b* available with the embodiment shown in FIGS. 9 and 10. In the graph, a curve F is associated with the embodiment while a curve E is associated with a comparative example whose reflectivity is 50%. As the graph indicates, the tubular cover 21 having a highly reflective inner surface causes the heating roller 1 to be sharply heated to an expected level, thereby reducing the rise time to the expected operating temperature. FIG. 12 indicates the temperature characteristic of the fixing roller 1 to occur in a stand-by state and during operation. In FIG. 12, curves C and D pertain to the embodiment and the comparative example, respectively. As shown, in the comparative example lacking the cover 21, the temperature characteristic of the roller 1 fluctuates during image formation. By contrast, the embodiment with the cover 21 maintains the temperature characteristic constant even during image formation, thereby insuring stable image formation. It is to be noted that the cover 21 may be made of SUS or similar material other than aluminum and may have the inner surface thereof polished by a method other than electrolysis, e.g., vapor deposition, Alumite (trade name) treatment, plating or similar surface treatment.

Figure 13:
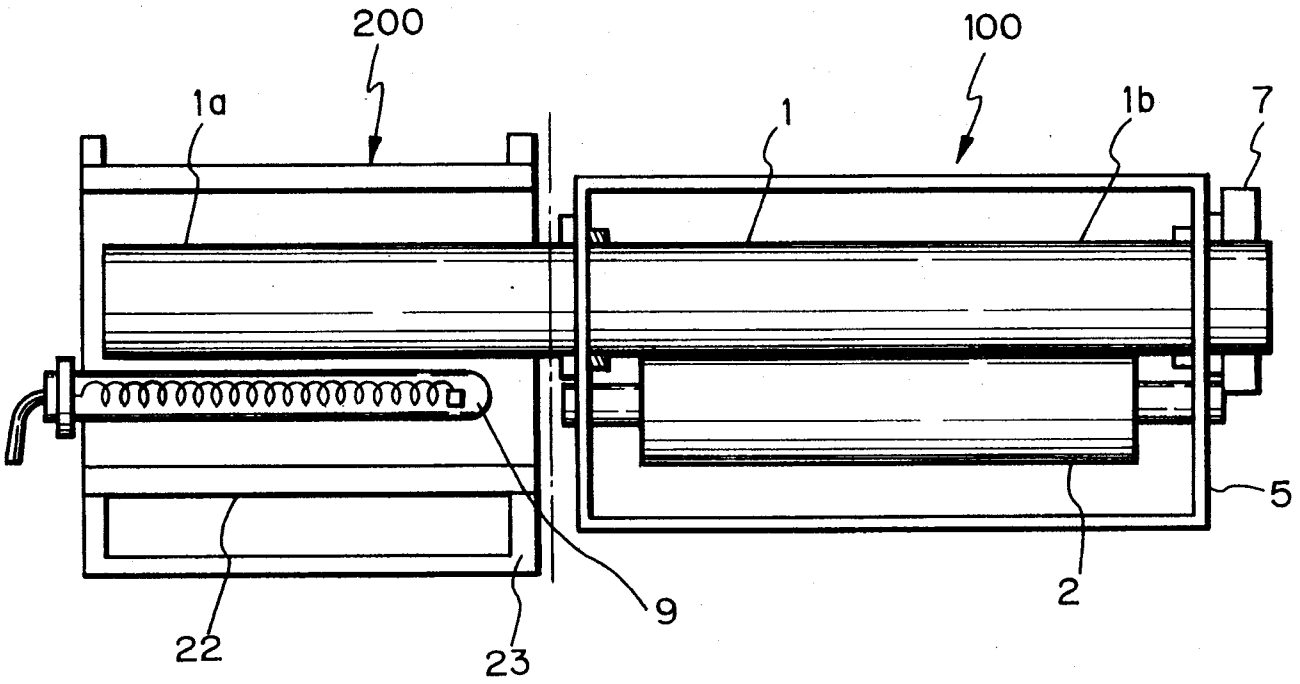
FIG. 13 and 14 are vertical sections showing a further alternative embodiment of the present invention.
Figure 14:
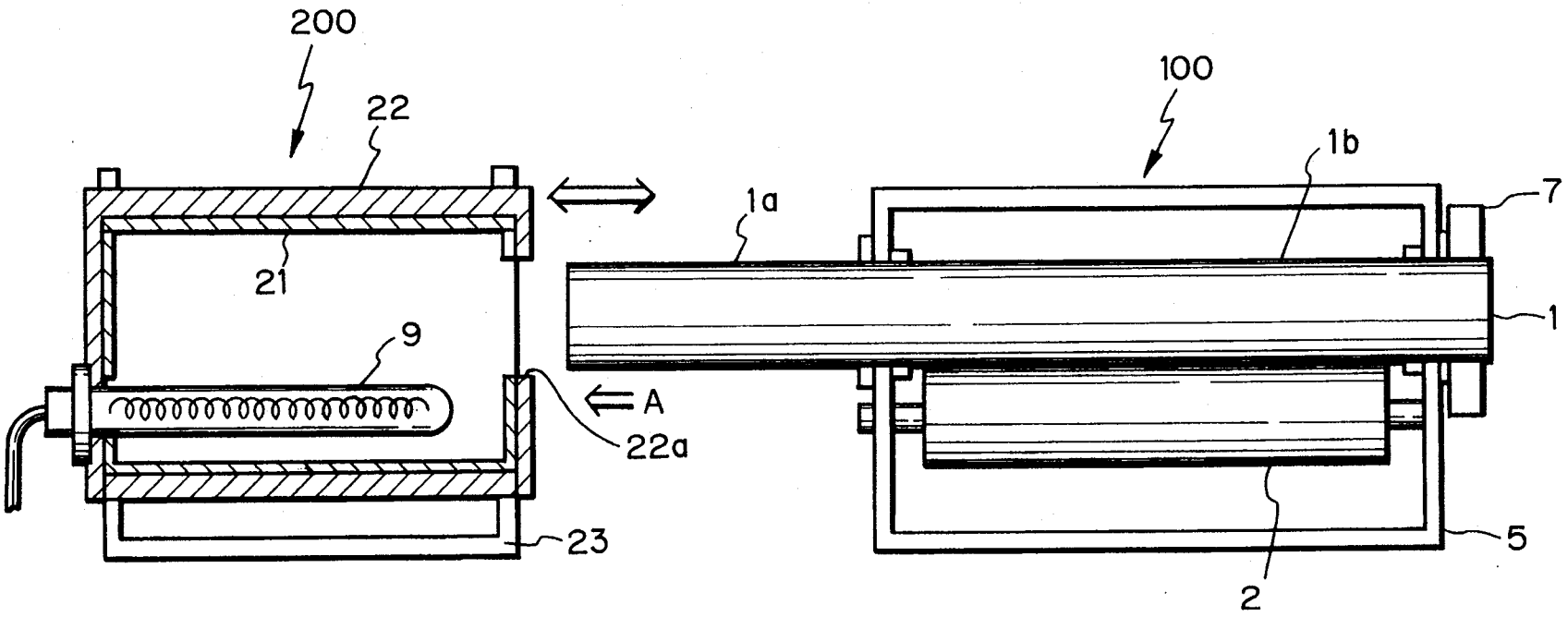
Figure 15:
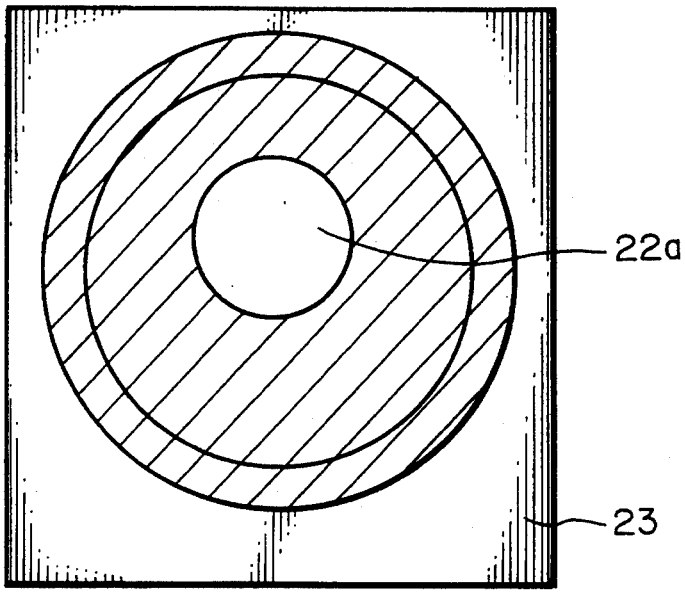
FIG. 15 is a vertical section perpendicular to the axis of a fixing roller, showing a halogen heater unit.
Figure 16:
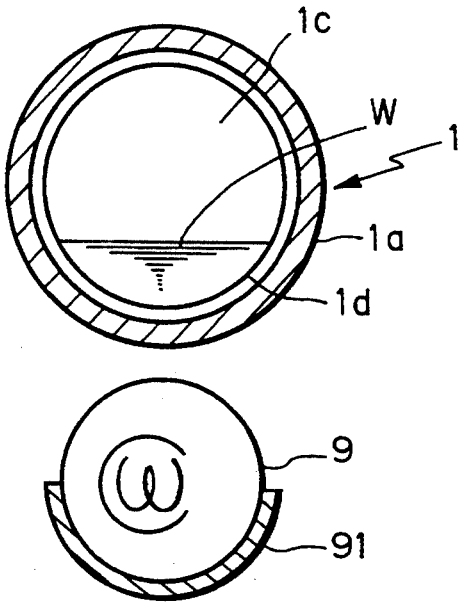
FIG. 16 shows the internal arrangement of the halogen heater unit specifically.

Referring to FIGS. 13, 14, 15 and 16, a further alternative embodiment of the present invention will be described. As shown, the fixing device is generally made up of a fixing roller unit 100 and a halogen heater unit 200. As shown in FIG. 14, the halogen heater unit 200 is removable from the fixing roller unit 100 when moved away from the unit 100 in the axial direction of the fixing roller 1. FIG. 15 is a vertical section of the halogen heater unit 200 perpendicular to the axis of the roller 1, while FIG. 16 shows the internal arrangement of the unit 200 specifically. As shown in FIGS. 13 and 14, the roller unit 100 has the fixing roller 1, pressing roller 2 pressed against the roller 1, side panels 5 supporting the rollers 1 and 2, and drive gear 7. The heater unit 200 has, in addition to the heater 9 and cover 21, a cover holder 22 and side walls 23 supporting the cover holder 22. One end portion of the fixing roller 1 extends into the heater unit 200 through an opening **22*a* formed through the cover holder 22. The halogen heater 9 heats the roller 1** from below.

As shown in FIG. 16, the previously stated mesh portion **1*d* covers the inner periphery of the heating portion 1*a* of the fixing roller 1 which is made of copper. The halogen heater 9 is disposed below the fixing roller 1. The part of the roller 1 that faces the halogen heater 9 is colored black. A ceramic coating 91 is provided on the lower portion of the halogen heater 9 in order to radiate heat upwardly with efficiency. The tubular cover 21 covers the entire heater 9 and the heating portion 1*a* of the roller 1**.

The roller unit 100 and heater unit 200 are physically independent of each other. Specifically, the two units 100 and 200 are individually fastened to the body of an apparatus by screws, not shown, but not fastened to each other. After the screws fastening, for example, the roller unit 100 to the apparatus body have been removed, the roller unit 100 is moved to the right, as shown in FIG. 14. As a result, the units 100 and 200 are readily separated from each other. Hence, when the halogen heater 9, for example, fails, it can be replaced easily. This is desirable from the maintenance standpoint.

Figure 17:
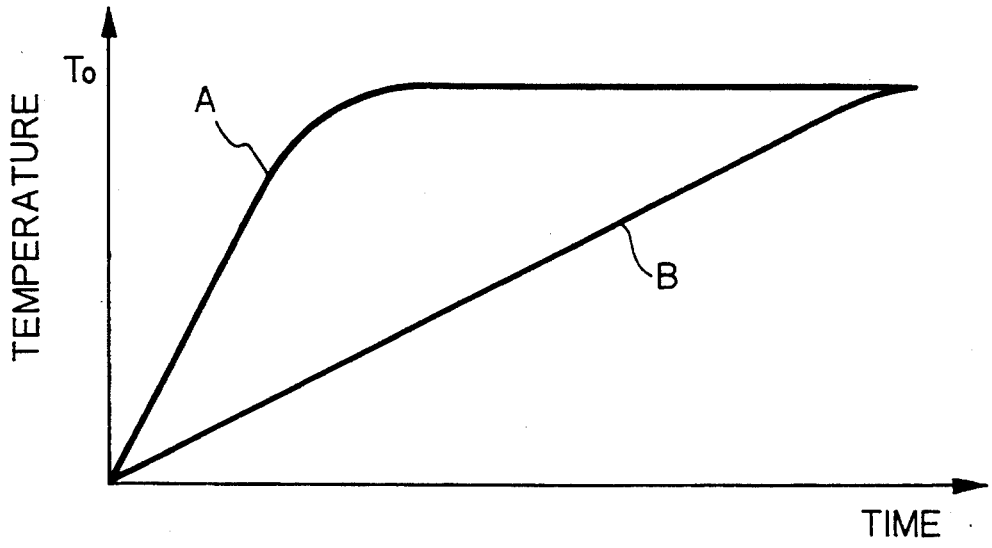
FIG. 17 is a graph indicative of the temperature elevation characteristic of a paper nipping portion of a fixing roller.
Figure 18:
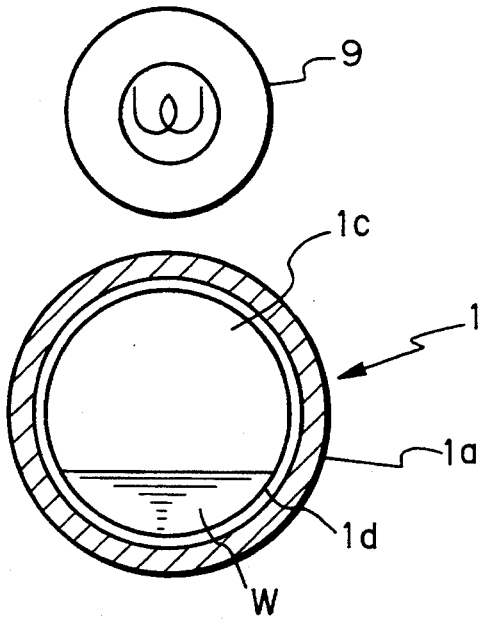
Fig. 18 PRIOR ART
FIG. 18 shows a conventional image fixing device.

FIG. 18 shows a conventional fixing device in which the halogen heater 9 is located above the heating portion **1*a* of the fixing roller 1. FIG. 17 is a graph comparing the embodiment of FIGS. 13–16 and the conventional device of FIG. 18 with respect to the temperature elevation characteristic. In the graph, curves A and B are associated with the embodiment and the conventional device, respectively. As FIG. 17 indicates, the fixing roller 1 of the embodiment reaches the expected operating temperature in a far shorter period of time than the roller 1** of the conventional device.

In summary, it will be seen that the present invention provides an image fixing device having various unprecedented advantages, as enumerated below.

(1) A heating roller has a heating portion greater in outside diameter than a paper nipping portion. Hence, the amount of heat received and the amount of fluid accommodated available with the heating portion per unit length in the axial direction are respectively greater than the amount of heat radiation and the amount of fluid accommodated available with the paper nipping portion. This allows the length of the heating portion in the axial direction to be reduced, thereby enhancing the miniaturization and safety operation of the device.

(2) The temperature of the heating portion is so controlled as to remain in a range lower than the breakdown limit of the heating portion and higher than the heat radiation temperature of the paper nipping portion. Therefore, a stable image fixing ability is achievable without damaging the fixing roller.

(3) Since the paper nipping portion has a greater wall thickness than the heating portion, the fixing roller is prevented from deforming despite the pressing contact of a pressing roller therewith.

(4) A rigid metal tube is fitted on the outer periphery of the tubular paper nipping portion which constitutes a heat pipe. This prevents the fixing roller from deforming due to the pressing contact of the pressing roller therewith without resorting to complicated surface treatment and by use of an inexpensive material.

(5) Means for transmitting rotation to the fixing roller is implemented as a heat insulating member and directly mounted on the fixing roller or mounted on a metal tube fitted on the outer periphery of the roller. As a result, the number of constituent parts and, therefore, the cost is reduced. In addition, easy assembly is promoted.

(6) A fluoric resin layer is formed on the outer periphery of the paper nipping portion of the fixing roller or on the metal tube fitted on the roller, thereby enhancing the fixing ability of the device.

(7) Since a heat source for heating the heating portion of the fixing roller is located below the heating portion, heat generated by the heat source is transferred to a working fluid efficiently. Consequently, the period of time necessary for the heating roller to reach a predetermined operating temperature is reduced.

(8) A hollow cylindrical cover covers the heating portion of the heating roller and the entire heat source, causing the heat from the heat source to concentrate on the heating portion of the roller. This is successful in preventing the temperature of the paper nipping portion from fluctuating while the fixing roller is in rotation, while enhancing efficient heating.

(9) Supporting means supports the heat source such that the heat source is removable from the fixing roller in the axial direction of the roller. Therefore, the fixing roller, heat source and other constituent parts are easy to replace.

Various modifications will become possible for those skilled in the art after receiving the teachings of the present disclosure without departing from the scope thereof.

What is claimed is:

1. A device for fixing a toner image transferred to a paper on said paper by heat and pressure, comprising:

a fixing roller implemented by a hollow cylindrical heat pipe having opposite ends thereof closed and filled with a working fluid, said heat pipe comprising a heating portion at one end portion thereof which is to be heated, and a paper nipping portion to be supplied with vapor of said working fluid vaporized by heat from said heating portion and to be heated by condensation of said vapor; and a pressing roller held in pressing contact with said paper nipping portion of said heat pipe, wherein the toner image is fixed on the paper when the paper is conveyed by said fixing roller and said pressing roller;

the device further including a heater disposed adjacent an outer surface of said heating portion of said heat pipe with said heater disposed outside of said heat pipe, such that said heater heats said heating portion at one end portion of said heat pipe by way of said outer surface of said heating portion and said working fluid is vaporized by heat in said heating portion.

2. A device for fixing a toner image transferred to a paper on said paper by heat and pressure, comprising:

a fixing roller implemented by a hollow cylindrical heat pipe having opposite ends thereof closed and filled with a working fluid, said heat pipe comprising a heating portion at one end portion thereof which is to be heated, and a paper nipping portion to be supplied with vapor of said working fluid vaporized by heat from said heating portion and to be heated by condensation of said vapor; and a pressing roller held in pressing contact with said paper nipping portion of said heat pipe wherein the toner image is fixed on the paper when the paper is converted by said fixing roller and said pressing roller;

wherein said heating portion of said heat pipe has a greater outside diameter than said paper nipping portion.

3. A device as claimed in claim 2, wherein said heating portion of said heat pipe is heated to a temperature lower than a breakdown limit of said fixing roller and higher than a heat radiation temperature of said paper nipping portion.

4. A device as claimed in claim 2, further comprising a reinforcing tube mounted on and surrounding the outer periphery of said paper nipping portion of said heat pipe.

5. A device as claimed in claim 4, further comprising a fluoric resin layer covering the outer periphery of said reinforcing tube.

6. A device as claimed in claim 2, further comprising a heat source located below said heating portion of said heat pipe for heating said heating portion.

7. A device as claimed in claim 6, further comprising a hollow cylindrical cover covering said heating portion of said heat pipe and entirety of said heat source.

8. A device as claimed in claim 7, further comprising supporting means for supporting said heat source such that said heat source is removable from said fixing roller in an axial direction of said fixing roller.

9. A device for fixing a toner image transferred to a paper on said paper by heat and pressure, comprising:

a fixing roller implemented by a hollow cylindrical heat pipe having opposite ends thereof closed and filled with a working fluid, said heat pipe comprising a heating portion at one end portion thereof which is to be heated, and a paper nipping portion to be supplied with vapor of said working fluid vaporized by heat from said heating portion and to be heated by condensation of said vapor; and a pressing roller held in pressing contact with said paper nipping portion of said heat pipe, wherein the toner image is fixed on the paper when the paper is conveyed by said fixing roller and said pressing roller;

wherein said paper nipping portion of said heat pipe has a greater wall thickness than said heating portion.

10. A device as claimed in claim 9, further comprising transmitting means for transmitting rotation to said fixing roller and implemented by a heat insulating member.

11. A device as claimed in claim 10, wherein said transmitting means is directly mounted on said fixing roller.

12. A device as claimed in claim 10, wherein said transmitting means is mounted on a reinforcing tube mounted on and surrounding the outer periphery of said paper nipping portion of said heat pipe.

13. A device as claimed in claim 9, further comprising a reinforcing tube mounted on and surrounding the outer periphery of said paper nipping portion of said heat pipe.

14. A device as claimed in claim 13, further comprising a fluoric resin layer formed on the outer periphery of said reinforcing tube.

15. A device as claimed in claim 9, further comprising a heat source disposed below said heating portion of said heat pipe for heating said heating portion.

16. A device as claimed in claim 15, further comprising a hollow cylindrical cover covering said heating portion of said heat pipe and entirety of said heat source.

17. A device as claimed in claim 16, further comprising supporting means for supporting said heat source such that said heat source is removable from said fixing roller in an axial direction of said fixing roller.

18. A device for fixing a toner image transferred to a paper on said paper by heat and pressure, comprising:

a fixing roller implemented by a hollow cylindrical heat pipe having opposite ends thereof closed and filled with a working fluid, said heat pipe comprising a heating portion at one end portion thereof which is to be heated, and a paper nipping portion to be supplied with vapor of said working fluid vaporized by heat from said heating portion and to be heated by condensation of said vapor; and a pressing roller held in pressing contact with said paper nipping portion of said heat pipe, wherein the toner image is fixed on the paper when the paper is conveyed by said fixing roller and said pressing roller;

the device further comprising a highly rigid metal tube mounted on and surrounding said paper nipping portion of said heat pipe.

19. A device as claimed in claim 18, further comprising transmitting means for transmitting rotation to said fixing roller and implemented by a heat insulating member.

20. A device as claimed in claim 19, wherein said transmitting means is directly mounted on said fixing roller.

21. A device as claimed in claim 19, wherein said transmitting means is mounted on a reinforcing tube mounted on and surrounding the outer periphery of said paper nipping portion of said heat pipe.

22. A device as claimed in claim 19, further comprising a heat source disposed below said heating portion of said heat pipe for heating said heating portion.

23. A device as claimed in claim 22, further comprising a hollow cylindrical cover covering said heating portion of said heat pipe and entirety of said heat source.

24. A device as claimed in claim 23, further comprising supporting means for supporting said heat source such that said heat source is removable from said fixing roller in an axial direction of said fixing roller.

25. A device as claimed in claim 18, further comprising a reinforcing tube mounted on and surrounding the outer periphery of said paper nipping portion of said heat pipe.

26. A device as claimed in claim 25, further comprising a fluoric resin layer formed on the outer periphery of said reinforcing tube.

* * * * *